United States Patent [19]

Farago et al.

[11] 3,966,560

[45] June 29, 1976

[54] METHOD OF CALCINING COKE IN A ROTARY KILN

[75] Inventors: Frank John Farago; Raman Radha Sood; David Michael Stokes, all of Arvida, Canada

[73] Assignee: Alcan Research and Development Limited, Montreal, Canada

[22] Filed: May 6, 1974

[21] Appl. No.: 467,376

[52] U.S. Cl. ..... 201/32; 201/1; 201/15; 201/27; 201/41; 432/18; 432/19; 432/24; 432/26

[51] Int. Cl.[2] ..... C10B 49/00; C10B 49/06; C10B 57/16

[58] Field of Search ..... 201/1, 15, 27, 32, 41; 202/131, 218, 270, 151, 128, 117; 432/111, 108, 117, 13, 7, 18, 19, 26, 36, 45, 54, 103, 24

[56] References Cited

UNITED STATES PATENTS

| | | | |
|---|---|---|---|
| 1,564,730 | 12/1925 | Walden | 201/27 X |
| 2,484,911 | 10/1949 | Seil | 432/110 X |
| 2,813,822 | 11/1957 | Collier | 201/27 X |
| 3,506,542 | 4/1970 | Kulakov | 202/151 X |

FOREIGN PATENTS OR APPLICATIONS

| | | | |
|---|---|---|---|
| 408,841 | 5/1966 | Australia | 202/218 |

OTHER PUBLICATIONS

Fekula et al.; 'Controlled Atmosphere;' 1958; pp. C-20 & C-22; The Petroleum Eng'R.

Perry et al.; "Chem. Eng'r. Handbook;" 1963; pp. 7-3; McGraw-Hill Book Co.

*Primary Examiner*—Morris O. Wolk
*Assistant Examiner*—Bradley R. Garris
*Attorney, Agent, or Firm*—Cooper, Dunham, Clark, Griffin & Moran

[57] ABSTRACT

In the calcination of petroleum coke in a rotary kiln, procedure wherein air is controllably supplied internally of the kiln to burn the removed volatiles, as by selection or adjustment of the amount of such air and of the speed of coke travel down the kiln, so that all or nearly all of the heat for calcining the coke is provided by such combustion, and so that a suitably high temperature is reached for effective calcination at an efficiently large feed rate of coke, a special feature being to maintain a significantly long travel time of the coke from a region of intense calcining activity to the product discharge end of the kiln. High production rates, of coke calcined well and uniformly, are economically attained, with ease of control and with unusual stability of kiln operation.

13 Claims, 2 Drawing Figures

METHOD OF CALCINING COKE IN A ROTARY KILN

BACKGROUND OF THE INVENTION

This invention relates to the calcination of carbonaceous materials, particularly petroleum coke such as intended to provide carbon for making electrodes or the like. Calcining operations of this sort are commonly performed in a rotary kiln into which the green petroleum coke in suitable particulate form is fed at one end, for delivery of treated product at the other end. In the kiln, the coke is calcined at high temperature, to drive off the volatiles and moisture and shrink the coke to a predetermined, desired density. The calcined product is useful for carbon elements and structures, notably for various situations of electrical function, such as in high temperature electrochemical operations, and most particularly for anodes and lining compositions in aluminum reduction cells.

The calcining process requires adequate heating for a desirably high production rate of calcined coke, while at the same time the heating is very preferably achieved inside the kiln without substantial combustion of the carbon itself. As will be understood, the green, granular coke entering the feed end of the tubular kiln flows down the kiln at a rate depending mainly on the kiln slope, for example falling 0.5 inch per foot of run from feed end to discharge end, on diameter, for example from 6 to 15 feet, and on the kiln speed of rotation, for example in the range of 0.5 to 3 r.p.m. Provision is made for supplying heat by firing with oil or natural gas burners into the lower end of the kiln, i.e. through the hood which includes the latter. The hot products of combustion, being flame and burned gas, are thus projected into the kiln, where the hot gases flow countercurrently to the descending coke bed.

In past practice, a considerable amount of heat has also been obtained by burning the released volatile materials from the coke, i.e. consuming a substantial quantity, although by no means all, of such volatiles. Air for combustion can be supplied in part from the lower end of the kiln, where such air is introduced with or separately from the fuel, but a considerable amount of air for the combustion processes utilizing the volatiles can be introduced in central regions of the kiln, using one or more fans or blowers mounted on the exterior of the kiln shell (and rotating with it) that supply air through nozzles or ducts opening into the interior of the kiln. The excess of volatiles and the combustion products of the described burning operations are carried off in the countercurrent flow of all gases, out the gas discharge which is the coke feed end of the kiln, and commonly the excess of volatiles is used for burning elsewhere, to recover heat, e.g. with a steam boiler.

As thus explained, it has been past practice to provide heat from two sources, particularly including the fuel-fired burner at the coke discharge end of the kiln, which conventionally provides a substantial percentage of the required heat energy. Whether the supplemental fuel burner has operated continuously or in some instances intermittently (being turned off for possibly recurring times when temperature conditions have temporarily reached a sufficient point), reliance has nevertheless been placed on the supplemental fuel, as representing in a sense the primary source of at least about one third and often more than half of the required heat for calcination.

As explained above, the desired result involves removing from the charge of green petroleum coke all moisture and nearly all volatile matter while at the same time (at least in part as a separate result of heating) altering the physical nature of the coke especially by increasing its real density. More specifically, the desired physical change in the coke includes removal of moisture and volatiles, as stated, and an increase of real density e.g. up to about 2.1 g/cc (grams per cubic centimeter) and likewise an improvement in average crystallite size up to 35 Angstroms, it being understood that the mean crystallite thickness of green petroleum coke may be less than 18 Angstroms.

Although effective calcining of petroleum coke can be achieved by past practice, unstable conditions have often occurred at high production rates and control has therefore been difficult when trying to obtain such rates with desired characteristics of density and volatile removal. Past practice, for best results, has tended to consider that the heating, combustion of volatiles, and effectiveness of calcination require the condition of maximum temperature of the coke to exist at or persist to a locality very close to the coke discharge end of the kiln. As indicated above, if there is significant combustion of the carbon, as might be occasioned with greater supply of air for combustion of fuel or volatiles, the production rate of useful coke suffers. On the other hand, insufficient combustion of volatiles or fuel may fail to reach the desired results or may again limit production by requiring reduction of green coke feed rate in order to permit the available heat to reach proper calcination conditions and temperature.

Experience has also indicated that the usual procedures can sometimes be erratic and the hoped-for results of good production rate and fully calcined product are sometimes difficult to obtain consistently where the nature of the green coke varies, especially in its content of volatiles as is often the case. Procedures have been developed for making some measurements of temperature rather effectively near the discharge end of the kiln, or by observing some of the characteristics of the operation, somewhat further inside, e.g. visually or by television, yet the desired factors have remained difficult to control. Very careful attention has been needed to reach full calcination in even moderately efficient manner, and especially to account for erratic conditions or to avoid erratic results.

SUMMARY OF THE INVENTION

For improved operation of the process of calcining coke, i.e. petroleum coke, in a rotary kiln, and particularly for simplified, more effective and more stable control of the operation, the present invention embraces the discovery that such control is attainable, relative to a desired feed rate for the selected coke, by suitable adjustment of: (1) the amount of air introduced for combustion of released volatiles; and (2) the speed of travel of the coke, such speed being conveniently adjusted by altering the rate of rotation of the kiln. It has been found that by adjustment of one or both of these conditions as necessary and having regard to the point or region of maximum temperature reached by the coke in its travel downstream, i.e. from feed end to discharge end, unusual results are attained where such maximum temperature point or region resides in what can be considered a calcining zone (meaning a zone of intense calcination activity) and where such point or the equivalent upstream end of such region is situated unusually far up the kiln from the discharge end, so that the coke has a specifically significant travel time in the kiln below such point, i.e. selected in a range of five or more minutes (for example 5 to 15), at high but lessening temperature, to the discharge end.

An important aspect of the invention is that it obtains from 75% to 100% (preferably at least 85%) of the heat needed for calcination by combustion of the removed volatile material inside the kiln. Indeed, a special feature of the improved procedure is that all of the required heat for calcining the coke can be derived by burning the volatiles, with unusual efficiency, in that at the same time a high productivity, in terms of coke feed and product delivery, is obtainable. It is found, too, that excess unburned volatile is normally left, in desired amount, comparable to past practice, so that the gas discharged from the kiln can be used for energy recovery in ordinary fashion, as by burning to heat a boiler or other equipment. This reference to operation with relatively little or very preferably no supplemental fuel means that such is the situation of the continuing function of the process; of course, supplemental heat, as by the usual burner or other means, is necessary for start-up, but can be discontinued as soon as the coke in the kiln has been well heated to or approaching the desired calcining temperature and has commenced to deliver a substantial flow of volatiles, which have become ignited.

In a general sense, the process of the invention involves, at least indirectly, determining the value of the maximum temperature reached by the coke in its travel through the kiln and the location of the point or region where such temperature is achieved. It appears that this region is normally relatively short lengthwise of the kiln. Even if it is found to represent temperature condition over an appreciable longitudinal distance, the point of interest in the present invention, which may be considered the point of maximum temperature for purposes of definition, is the point furthest from the discharge end. In this general sense, the preferred operation involves keeping the maximum temperature at a desired value, for example in the range upwards of about 1,800°F, (preferably at least 2,000°F) and most advantageously in the range of 2,300° to 2,500°F, or in some instances higher, very preferably at about 2,400°F, while locating the defined point of such temperature at an unusually large distance upstream of the discharge end, yet by no means close to the feed end, being such that the coke travels for about five to fifteen minutes, or more, very preferably at least about ten minutes from such point until it discharges.

As indicated above, these conditions are achieved by simple adjustments, e.g. by selecting or varying one or more of the factors of kiln rotation speed and amount of air supplied for combustion of volatiles. Ordinarily, there is no need for supplemental fuel or corresponding supplemental heat, once the operation has been started up, but in a general sense the advantages of the process are realized even with use of a minor proportion of extra fuel, e.g. oil or gas, fired in a burner projecting into the discharge end. It is considered that less than 25%, indeed an amount less than 20%, of the total heat requirements might conceivably be so supplied withbut losing a number of advantages of the invention; very preferably such supplemental heat should not be more than about 10%, or possibly 15%, of the total requirement. Supplemental heat could be necessary with green coke that has unusual characteristics, such as extremely low volatiles or high moisture. Ordinarily, petroleum coke has been found appropriate for processing in accordance with the present invention, where no supplemental fuel is employed.

As indicated, although in some instances air can be supplied in part through the discharge end, the chief supply of air for combustion of volatiles, and indeed very preferably all of such air, is normally introduced through suitable means opening into the interior of the kiln at a place or places well upstream from the discharge end, indeed at a distance, from such end, of at least one quarter of the total length of the kiln and preferably of at least about one third of the total kiln length, or further, and also preferably well displaced from the feed (gas outlet) end of the kiln, e.g. by more than one third of the kiln length. Commonly, such air supply may consist of a series of openings spaced along the kiln, connected with appropriate means for controllable supply of air, embracing one or more fans with suitable flow control, either in the ducting or by speed control of the fans.

There appears to be special significance in the location of the air supply means or tuyeres. Indeed, in presently preferred practice of the invention, the point where it is desired to attain the maximum temperature should be ideally in the vicinity of, or generally no more downstream than that one of the air supply means which is nearest the discharge end of the kiln. Hence the distance from such furthest downstream tuyere to the end of the kiln can preferably be such as to afford the required time for coke travel, e.g. at least more than five minutes and, with special advantage, in the range of about ten to fifteen minutes.

With these considerations in mind, experience in proper adjustment of the control factors of kiln speed and combustion air indicates that the desired results are achieved when the downstream end of a physical disturbance in the travelling coke bed, usually a state of fluidization, approximately coincides with the furthest downstream tuyere or like element that delivers air into the kiln. In such cirumstances, and with the air flow and kiln speed adjusted to achieve the desired maximum temperature, it appears that the point of such temperature (as defined above) locates itself at or a little above this same lowermost point of bed disturbance, i.e. adjacent, or at least roughly adjacent, the lowermost air opening.

Various modes of determining kiln conditions are useful in practicing the invention. For example, it is found that ordinarily the temperature near the discharge end of the kiln bears a relation to the maximum coke bed temperature achieved upstream. Moreover, the location of the downstream end of the special calcining disturbance of the bed can be detected in appropriate circumstances by visual inspection or advantageously by optical means such as television inspection through the discharge end of the kiln. It is also found that proper kiln operation can be checked, if desired at frequent intervals, by X-ray diffraction measurements which relate to the maximum temperature obtained in the kiln, determining the real density of the product and indeed also affording a measure of its desired crystalline characteristics.

While these procedures have been found convenient and useful, the temperature of the coke bed near the end of the kiln being readily measured with an optical pyrometer which is focused on such bed or on the adjacent inside kiln wall and delivers suitable radiation-responsive signals, other means of measuring kiln conditions, including other temperature-measuring instrumentalities and other ways of inspecting or monitoring interior operations, may be used. Indeed, useful information, which can be correlated with the desired internal conditions of maximum kiln temperature and location of such maximum, is also obtainable from feed end readings, especially the feed end temperature of the exit gases. It is possible that under suitable circumstances certain conditions inside a kiln may be determinable essentially alone by the feed end outgoing gas temperature and the discharge end coke bed temperature, but such procedure is the subject of separate development, by no means required for the present invention and therefore not set forth nor intended to be claimed herein.

In addition to economy in avoidance of supplemental fuel, while achieving unusually good calcination, to a high density with nearly all of the volatiles removed, the present invention achieves other advantages. When the specified conditions are maintained for the above results, burning of the carbon is usually kept to the minimum of good past practice, or reduced, as is desired in calcining, for high efficiency. Improved production rates are obtainable, in a manner found to be correlated with the usually long residence time after the coke reaches maximum temperature, yet there need be no increase of total residence time in the kiln, nor undue increase in the porosity of the product as sometimes occurs when green coke is heated too fast. The control operation is extremely simple and relatively very stable (a very important result), while achieving the better throughput and productivity mentioned above. The gas temperature at the feed end can be lower than is conventionally encountered, while the kiln gas velocity is also lower (flowing to and out of the feed end), with correspondingly substantially less carryover of dust, thereby in turn increasing overall recovery and decreasing the load on dust removal equipment. The discharge end temperature of the product coke may also be lower than usual, permitting longer refractory life and reducing repair and maintenance expense. Finally, more uniform calcination is achieved, throughout the continuously delivered stream of product coke. Additional details of the invention, and practical examples of its performance, are described hereinbelow, including further features of novelty and advantage.

DETAILED DESCRIPTION

Figure 1:
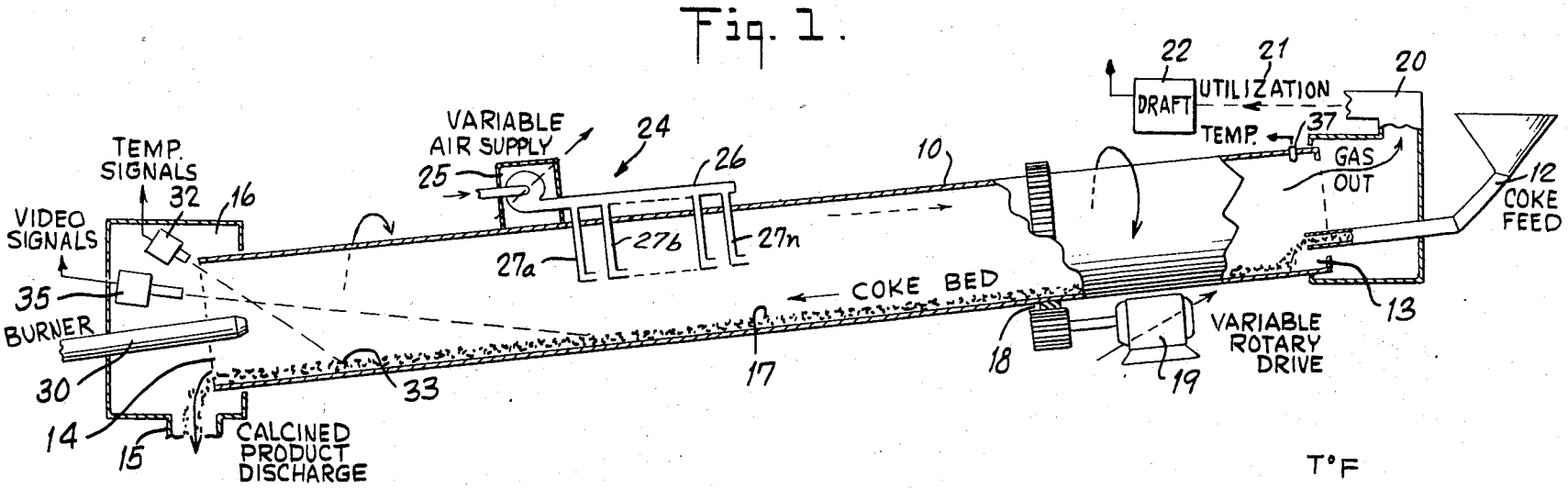
FIG. 1 is a diagrammatic view, showing a rotary kiln mostly in longitudinal vertical section and illustrating an example of operations and arrangements whereby an effective form of the invention can be carried out.

For illustration of the use of the invention, FIG. 1 shows a rotary kiln 10 into which granular petroleum coke is fed through an appropriate duct 12 at the upper, feed end 13 while the calcined coke is caused to be discharged at the opposite end 14 of the kiln, through an appropriate outlet 15 in a hood 16 which encloses the discharge end 14. The kiln is arranged with a downward slope, say ½ inch per foot, or more generally in the range of ¼ inch to 1 inch per foot, whereby the particulate coke under treatment travels as a continuous bed 17 along the inside bottom of the kiln, such travel being effected by rotating the kiln about its longitudinal axis, for example with a pinion and ring gear arrangement as at 18, having appropriate power driving means 19, such equipment being conventional, and being arranged for adjustment of speed of rotation, for instance within a range of 0.5 to 3.75 r.p.m., a suitable example being 2 to 2.5 r.p.m. for a kiln 8 feet in diameter.

Gases in the kiln flow countercurrently to the travel of the coke bed and are discharged at the feed end 13, for instance through suitable enclosure means 20 from which such gas, which ordinarily contains a useful content of unburned volatiles, is drawn to an appropriate locality for utilization as indicated at 21, preferably with the aid of suitable gas handling means or other draft control 22. The actual use of the discharged gases from the kiln is not a feature of the present invention, except for noting that although the invention preferably relies on burning only released volatiles for all of the heat of calcination, the discharged gases nevertheless usually contain remaining combustible valves for recovery of heat.

As the coke bed travels from feed to discharge, it is subjected to high temperature, here developed by burning the combustibles with the aid of air introduced by supply means 24, which includes a fan or blower 25 delivering air through a suitable manifold 26 from which it is injected into the kiln by one or more openings or nozzles, conveniently an array of such nozzles or tuyeres **27*a*, 27*b*, etc., through 27*n*. These nozzles, for example, can be spaced along the axis of the kiln, directing the air upstream toward the gas outlet end, whereby the materials being volatilized from the petroleum coke are burned in order to generate the desired heat for the calcining operation, i.e. the heat which effects such volatilization and which causes the increase of real density of the coke. The air supply through the means 24 and its nozzles 27*a* to 27*n* is adjustable in amount, e.g. in cubic feet per minute, as by varying the speed of the fan 25** or otherwise controlling the air flow in this delivery system.

The initial operation of the kiln is brought about by supplemental heat, as with a burner 30 which projects into the discharge end for raising the coke bed to calcining temperature at the beginning. When such temperature is reached, and the released volatile materials have been ignited, the burner may be turned off. Heat from the combustion of volatiles can thereafter be relied upon for the entire calcining function in presently preferred operation.

While a variety of indicating and observing means may be employed, the drawing shows an optical pyrometer 32 in the hood 16, arranged to inspect a locality 33 of the bed or adjacent interior kiln surface, conveniently near the discharge end 14. These temperature signals can be taken as representing the discharge end temperature and as varying with the maximum temperature at a point much further inside the kiln, indeed having a direct relation to such maximum temperature value (and to the coke product density) when the downstream end of the calcining disturbance of the bed is located at the desired place. Such condition of the bed is in turn observable either by direct visual inspection or, most conveniently, by a suitable television camera 35 aimed at the vicinity of the air supply tuyere 27*a* which is situated furthest downstream. As indicated above, directions downstream and upstream are herein expressed with reference to the travel of the coke from feed to discharge.

As mentioned, it is found that through the most active region of the kiln, especially where the volatile materials, in gaseous state, are being evolved, the coke bed becomes characteristically disturbed, i.e. is more or less fluidized. Hence the location and existence of this disturbed, i.e. fluidized or floating region of the coke bed can be detected, in a kiln of the size and nature herein described for example, by the television camera 35, from which video signals are transmitted for display on a suitable screen observed by the operator of the kiln. Measurement of the temperature at the feed end, specifically in the discharging gases, can be readily obtained with a suitable thermometer element schematically indicated at 37, which may be a thermocouple, or may be of other pyrometer type.

A further measurement, which in most cases need only be made from time to time, such as for example every hour or every one and one half or two hours, is the density of the product coke. Although this can be done by conventional direct determination, more satisfactory results are obtainable by X-ray diffraction (XRD) methods, for which suitable instruments are well known. The results can be read according to a scale of special XRD values, conveniently identified as Lc, which are correlated with real density and indeed can be correlated with the temperature of calcination, i.e. the maximum temperature reached by the coke in its travel through the kiln. Thus whereas the green coke may have a density (grams per cubic centimeter) of less than 1.6, e.g. 1.4, and the corresponding Lc values less than 20, good values for calcined coke are 2.0 g/cc and above, preferably at least 2.04 g/cc and Lc over 22, preferably at least 26. Indeed, with the present process, many petroleum cokes can be efficiently calcined to a density of 2.08 to 2.10 or above, with Lc well over 26, even up in the range of 30 to 35. In practice, it is found that when the XRD measurement (Lc) of the product bed is on target, the maximum temperature of the coke is necessarily at desired value.

Figure 2:
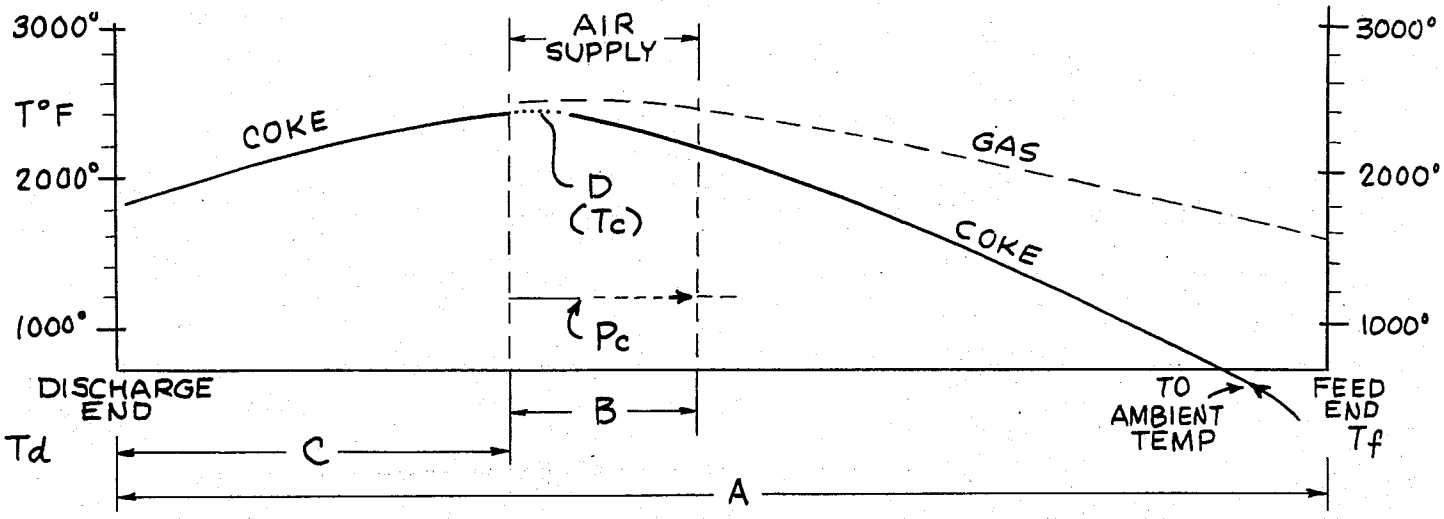
FIG. 2 is a graph roughly illustrating the longitudinal temperature profile of the coke, and (toward the feed end) the gas, along a kiln such as shown in FIG. 1, and on the same diagrammatic scale lengthwise, the profile being drawn in extremely simplified manner.

FIG. 2 is an example of a temperature profile, shown highly simplified, of the kiln shown in FIG. 1, which (also for example) may be assumed to be 200 feet in length A, 8 feet in diameter, sloping ½ inch per foot, rotating at a speed adjusted (according to the invention) in the vicinity of 2.5 r.p.m., and having a feed of green petroleum coke into the end 13 of about 25 tons per hour (t.p.h.). The tuyeres or nozzles 27, from three to ten, preferably five to eight in number, are distributed, in this example, over a linear distance B of 25 feet or more (up to, say, 60 feet) beginning with the first nozzle 27*a* at a distance C of about one quarter of the kiln length or more (here 66 feet — i.e. upwards of 60 feet, even as much as 90 feet) from the discharge end 14. The total air supply may be adjusted as required for the present process, for example within a range of 10,000 to 15,000 c.f.m. (cubic feet per minute) or sometimes more. Total residence time of coke in the kiln is about 45 minutes or above, with the time from tuyere 27*a* to discharge end 14 being over five minutes, but very preferably upwards of about ten minutes, i.e. to about fifteen minutes.

The operating conditions for FIGS. 1 and 2 are considered to be adjusted in accordance with the invention and to achieve an Lc value of about 26 on XRD test, i.e. setting the rate of advance of the coke bed, by suitably adjusting the speed of kiln rotation, and adjusting the amount of air supplied to the tuyeres, in such manner that the furthest downstream point of substantial bed fluidization is located approximately at nozzle 27*a*, and the discharge end temperature, as read by pyrometer 32, is approximately 1,800°F, while the coke bed requires from 10 to 15 minutes to travel the distance C. The plot of FIG. 2 is then found to represent approximately the temperature profile lengthwise of the kiln (the profile being actually in curved lines, and the maximum gas temperature probably being higher than the coke) and in particular it is found that with the operating conditions adjusted as just described, the maximum temperature is reached by the coke at about the locality of the downstream end of the fluidized zone, i.e. at tuyere 27*a*, and has a desired value of about 2,400°F. The distance upstream from the stated locality through which this temperature condition exists is not critically established and is merely here indicated as D, but may be relatively short, especially for the coke which is believed to be still heating up as it advances well into the region of the tuyeres. If the product density is as desired, the process is functioning satisfactorily and the maximum temperature, at D, is about 2,400°F, while the feed end temperature, in the discharging gas, is found to be about 1,600°F.

If an XRD check shows that the product density is off the desired value, e.g. is significantly low despite apparent correctness of observed discharge temperature and bed disturbance position, a higher maximum temperature is needed; in such event, the conditions are adjusted, for example, by increasing the air supply and altering the kiln speed as may be necessary, while observing conditions of temperature and fluidized position, and then rechecking the product density, say 30 to 45 minutes later.

In starting up, the burner 30 is used to bring the descending coke bed up to a high temperature, thereby initiating the calcining process, with release of volatiles. The air supply 25 is started, and the volatiles become ignited, so that when desired temperatures are reached the burner is shut off. Thereafter the invention contemplates keeping the calcining zone, and particularly the maximum temperature point at the downstream end of it, in a defined position, e.g. adjacent the tuyere 27*a*.

If the zone is too low, i.e. with its downstream end substantially below the lowest tuyere 27*a*, there will not be enough air available to burn the volatiles and provide the energy required for calcination. Moreover there will be the possibility of carrying unburned volatiles too far down the kiln, while a number of other new results of the process, including lower discharge temperature and saving of heat, may not be realized. If the calcining zone is too high, as for example with its downstream end more than half the length of the kiln from the discharge locality, there may not be enough time for desired heat transfer to the coke and correspondingly proper calcination. The porosity of the product can increase undesirably, and there may be no attainment of other new advantages, such as the reduction of dust loss, and the simplification of dust collection and pollution control.

Indeed, the desired provision of stable kiln operation, while achieving excellent calcination with a maximum of feed and very preferably avoiding any need for supplemental fuel (more than 75%, or conveniently 85% or upwards of heat needs being served by burning volatiles in any case), is only attained when the calcining zone and the maximum temperature in the travelling bed are so located that there is a relatively long travel time for the coke as it completes calcination and is discharged, i.e. more than five minutes and most advantageously about ten to fifteen minutes or so. A primary process factor, of course, is the value of the maximum temperature, which is selected or adjusted to suit the properties of the coke, and can be monitored by readings of the discharge temperature, providing the calcination zone is in suitable position.

As indicated, the control of the operations in most circumstances is very simple. With a selected rate of coke feed 12, the flow rate of the air supply 25, and the kiln speed governed by the rotary drive 19 are respectively selected or adjusted to control the calcination temperature and the calcination zone position. Increases in kiln r.p.m., which increase the speed of travel of the coke bed, will move the calcining zone $P_c$ (for example, preferably desired to occupy the region B), and maximum temperature locality, downward toward the discharge end, while decreases in kiln rotation will have the opposite effect. There can be a minor effect of changes of r.p.m. on the maximum temperature $T_c$, in that any change of zone position may tend to change the temperature a little, but such effects can be monitored by the discharge end temperature $T_d$ and other adjustment made, as of the air supply, to change the temperature $T_c$ as necessary.

Increases in air supply, i.e. through the tuyeres 27, have the major effect of increasing the oxygen available for burning the volatiles and thus correspondingly tend to raise the calcination temperature $T_c$. Lowering the air supply correspondingly lowers $T_c$. There is a minor, but sometimes significant, effect of increases of air supply in causing the calcining zone to move upstream, while conversely decreases in air supply may permit the calcining zone to move or drift somewhat downstream. As will be understood, changes in r.p.m. can be effected to correct such displacements, as monitored by television camera or other observation. Indeed in general it is not difficult to take advantage of the major effects of r.p.m. and air supply on zone position and temperature to balance out the minor effects of these variables and maintain optimal position and temperature.

In practice, it is presently preferred that changes in air supply be made only when the downstream end of the disturbed bed is approximately in proper position, e.g. adjacent the lowest tuyere, and then only in small increments while observing the feed and discharge temperatures and (by television camera or otherwise) the calcining zone position. The discharge end temperature $T_d$ bears a direct proportionality or relation to the maximum temperature $T_c$, i.e. increasing or decreasing with it, and indeed to a minor extent increasing or decreasing with the proximity of the downstream end of the calcining zone $P_c$. As will be appreciated, when the calcining zone is kept in proper position, the outlet (feed end) gas temperature $T_f$ increases or decreases with the calcining (maximum) temperature $T_c$, but $T_f$ of course also increases or decreases with movement of the calcining zone $P_c$ toward or away from the feed end of the kiln. Finally, the maximum temperature can be monitored from time to time by X-ray or other determinations or product density, which is found to be well correlated with such temperature.

With the foregoing in mind, and observing the indicated quantities, especially $T_d$ and the position of the calcining zone, and likewise, at less frequent intervals, the product density, desired control of the kiln operation is readily achieved. This can be supplemented by readings of the feed end temperature $T_f$. Primarily it is desirable to adjust the kiln speed so as to locate the end of the calcining zone at the desired place, i.e. near or just above the lowest air nozzle 27*a*. The air flow is adjusted to a level assumed for effective calcining temperature. A desired maximum temperature, say 2,400°F, having been selected, the outlet temperature $T_d$ is kept under observation and if within a desired range, say 1,780° to 1,850°F, it may be assumed that the maximum temperature is correct and the coke bed is travelling at the proper speed.

For example, however, if the temperature $T_d$ is too high, the air supply can be cut back and if necessary the r.p.m. can be reduced, such that the zone position $P_c$ remains correct while achieving a reduction of $T_d$ and getting $T_c$ down to its selected, economical value. If $T_d$ is too low, reverse corrections can be made to produce the reverse effect. In general, changes that are expected to alter the discharge end coke temperature are necessarily slow, and their effects usually will not be revealed for about one half hour. As a check on the correctness of control, feed end temperatures $T_f$ are significant as explained above.

It has been found that with operation in this manner, the calcining zone can be kept in the desired locality ($P_c$) and the maximum temperature ($T_c$) maintained at the desired value and indeed at the desired place, with stable operation. At the same time, the coke feed is usually kept at a desirable maximum, consonant with achieving the indicated results. For instance, in a kiln of the specific structure and dimensions given above, petroleum coke feeds up to 28 t.p.h. (tons per hour), over a considerable range of green coke properties, have generally been found feasible, for discharge of satisfactory product at a rate of 19 to 21 t.p.h., and of course very good results have been achieved at lower rates of feed, such as 25 t.p.h.

Investigation of the relation of process variables to productivity has demonstrated that the maximum useful feed rate can be increased with increase of the distance of the first air inlet 27*a* from the discharge end, and correspondingly with the location (at the same place) of the point of maximum temperature. Thus in tests with various kiln arrangements feed rates of 23, 25 and 28 t.p.h. were found to be maxima, for stable operation while achieving a desired density such as Lc of 26 plus, when the furthest downstream tuyere was situated at 47, 54 and 64 feet respectively from the discharge end 14 and the corresponding times of coke travel were 11, 12 and 14 minutes. As will be appreciated, best results when the air supply is situated relatively close to the discharge end, even down to 40 feet in the illustrated kiln, are achieved by slowing the rotation of the kiln so that the coke bed travel time is still well over 5 minutes, and preferably at least approaching 10 minutes. Shorter times of travel from highest temperature to the end, e.g. down to 5 minutes, may be involved where supplemental heat (burner 30) is found desirable.

A special feature of the invention, however, is that such extra heat is usually unnecessary; indeed when extra fuel is used, the significance of discharge end temperature tends to diminish in proportion,, and likewise the simplicity and effectiveness of the present process fall off, usually becoming lost with large quantities of extra heat. With an ordinary petroleum coke containing up to 12% volatile content, fed at a rate of 25 t.p.h., yielding 18 to 19 t.p.h. of product having a density of 2.0 to 2.1 g/cc, supplemental heat is ordinarily not required in the present process. In conventional past practice where much more than 25% of the heat, usually upwards of 50%, has been supplied by supplemental fuel, the end of the calcining zone and the locality of maximum temperature have been close to the discharge end. In such and other prior practice, especially for operation at high production rates, unstable conditions have tended to exist, e.g. in one or more of the factors of location and nature of the calcining zone, calcining temperature and movement of the coke. The present process, where the maximum temperature point is kept at least 5 minutes upstream from the discharge end, is notable in affording good stability at high production rates, with corresponding simplicity of control, while also achieving better uniformity of product, good heat transfer, and high efficiency.

Reliance on combustion of volatiles alone for the heat of calcination has been found to reduce substantially the amount of dust carried out of the kiln with the gas, as well as to lower the gas exhaust and product discharge temperatures, e.g. by amounts such as 100° to 300°F and 200°F respectively. In one set of tests where coke feed in the range of 22 to 24 t.p.h. was calcined to yield a product of about 2.1 g/cc density, operation with substantial supplemental heat, i.e. much more than 25%, results in a dust loss, in the gas, equal to 4 to 5% by weight, based on the product. When operation was effected by the present process, with no extra heat, the dust was only about 3% on the same basis. Thus materially product yield was improved and requirements for pollution abatement were reduced.

As an example, the maximum total air supply to burn 36.6% of the volatiles in a coke feed of 28 t.p.h. that contains 12.34% volatiles and 8% moisture, for delivery of product (about 19 t.p.h.) at a density of 2.0 to 2.1 g/cc and with max values of $T_f$ about 1,600°F and $T_d$ about 1,800°F, is calculated to be about 17,500 CFM. If only 30.8% of the volatile content is to be burned, the maximum air apppears to be about 16,150 CFM. In any instance the actual air supply, of course, is adjusted as required in accordance with the principles of the process as has been explained. The amount of air for combustion is the primary variable for achievement of desired calcining temperature and consequently for reaching desired density of product; indeed the basic adjustment is of the air supply, to accommodate any need for more or less heat, e.g. because of changes in particle size, moisture content or volatile content of the green coke.

While present theory is that for truly accurate control and for optimum avoidance of loss by oxidation of carbon, substantially all of such air is best supplied by one or more fan-tuyere systems as shown at 25–27 in FIG. 1, in practice a significant part of the air may come in by leakage at the discharge end 14 and indeed it appears that in effect useful, desired control of the total air can still be obtained by adjusting the supply 25. Where as usual, neither end of the kiln is sealed and safety dictates avoidance of any positive draft out of the kiln at 13 or 14, the discharge end 14 can be kept close to zero pressure difference from the exterior, to minimize air leakage inward and burning of the coke, and the feed (gas exit) end 13 can be kept under suitably negative pressure for flow of gas, under the influence of whatever draft control means 22 may be remotely connected in the exhaust gas system.

Although ordinarily the feed rate of green coke at 12 is selected for desired production within the stable capacity of the kiln, this is a variable that can also be adjusted for control of the process, and may need to be changed, as to avoid instability if it has been chosen too high, or to alter the kiln bed depth without changing kiln rotation, or simply to make a change in production of any reason. With other variables unchanged, a decrease in feed rate generally causes an increase in the maximum temperature and causes the calcining zone to move upstream in the kiln. If the feed is at its feasible maximum an increase leads to slides in the bed or other instability, with ultimate increase in the discharge end temperature. If the feed rate is below maximum, an increase causes a fall in the maximum temperature and movement of the zone downstream, and may cause temporary physical instability if too large a change is made at one time. It will be apparent that changes in temperature and zone position due to proper changes in feed can be counteracted by suitable adjustments of air supply and kiln rotation, in the manner explained above.

The procedure of the invention affords substantial improvement in the calcining of coke, and is applicable to a wide range of petroleum cokes, e.g. having a volatile content from 7. to 13%, or even more or less. In making full use of heat available by burning volatiles, high efficiency is achieved especially in that the volatile material so used is only about 4% of the green coke, thus leaving a large amount of volatile in the exhaust gas, suitable to burn elsewhere. Substantial economy, with insured minimum of carbon loss by oxidation, is achieved by the process, with other specific advantages as explained above, including a relatively short calcining (fluidized-bed) zone. The control is both simple and stable, being predicated on maintaining a desired value of maximum coke bed temperature and a desired position of such maximum and of the downstream end of the calcining zone, such value and position being determined by direct measurement or observation, or by indirect determinations (e.g. of discharge end temperature), indications or calculations. With appropriate selection or adjustment of the rate of feed of granular coke into the kiln, one or both of only two variables are adjusted, i.e. air supply and kiln rotation, with consequences as explained above, for effectuating maintenance of the described factors.

It is to be understood that the invention is not limited to the specific steps, operations and features herein described but may be carried out in other ways without departure from its spirit.

We claim:

1. In a method of calcining coke which travels from the upper feed end where said coke is fed at a desired rate to the lower discharge end of a sloping, rotary kiln, which has a predetermined slope, at a speed dependent on the speed of kiln rotation, while supplying heat to the traveling coke to calcine the coke by removing volatile material and increasing substantially the real density of the coke, the improvement which comprises causing combustion of removed volatile material within the kiln to supply 75 to 100% of the heat required for said calcination after preliminary heating to initiate the process, by supplying air into the kiln at localities within a zone which extends longitudinally between places spaced substantially from the discharge and feed ends respectively, while drawing the gaseous products of said combustion upstream through the kiln and out the feed end, said supply of heat being effective to raise the temperature of the coke as the coke travels from the feed end to a desired maximum value at a place spaced longitudinally upstream of the discharge end, while the temperature of the coke decreases in further travel from said maximum temperature place to the discharge end, said maximum temperature place being distinguished by an observable physical disturbance in the kiln which accompanies said removal and combustion of volatile material, said disturbance being located along only a longitudinally intermediate region of the kiln from which the substantially calcined coke travels beyond said disturbance to the discharge end, determining departures from the desired maximum temperature value and the desired location of said disturbance and adjusting said supply of air to said localities for sufficient combustion to maintain said desired maximum temperature value while adjusting the speed of kiln rotation to situate said maximum temperature at the desired place so that the coke travels for 5 minutes or more from the downstream end of said disturbance to the discharge end, thereby insuring uniform calcining treatment of the coke before it discharges.

2. A method as defined in claim 1 in which said combustion of removed volatile material is effected to provide at least 90% of said supply of heat required for said calcination, said supply of air being controlled to maintain said maximum temperature at a value of at least 1800° F.

3. A method as defined in claim 1, wherein said coke contains about 7% to 13% entrained, combustible, volatile material, said maximum temperature being maintained at a value of at least 2000°F and said maximum temperature place being maintained in such a location that the coke travels for at least about 10 minutes from the downstream end of said disturbance to the discharge end.

4. A method as defined in claim 3 in which said combustion of volatile material is effected to provide substantially all of said supply of heat required for calcination.

5. A method as defined in claim 3 in which said maximum temperature is maintained at a value of at least 2300°F to provide a density of at least about 2 g/cc in the discharged product coke.

6. In a method of calcining petroleum coke which travels from the upper feed end where said coke is fed at a desired control rate to the lower discharge end of a sloping, rotary kiln, which has a predetermined slope, at a speed dependent on the speed of kiln rotation, while supplying heat to the traveling coke to effect calcination by removing volatile material and increasing substantially the real density of the coke, the improvement which comprises causing combustion of removed volatile material within the kiln to supply 75% to 100% of the heat required for said calcination after preliminary heating to initiate the process, by supplying air forcibly into the kiln at one or more localities along the kiln, wherein the locality nearest the discharge end is longitudinally spaced substantially from said discharge end by a distance of at least about one fourth of the kiln length and the locality nearest the feed end is longitudinally spaced substantially from said feed end by at least an equal distance while drawing the gaseous products of said combustion upstream through the kiln and out the feed end, said supply of heat being effective to raise the temperature of the coke as it travels from the feed end to a desired maximum value at a place spaced longitudinally upstream of the discharge end, while the temperature of the coke decreases in further travel from said maximum temperature place to the discharge end, said supply of air and resulting combustion causing observable fluidized or floating disturbance of the coke bed along a longitudinal region which extends upstream from but not downstream from the locality nearest said discharge end and which defines said maximum temperature place, at least from time to time determining whether said maximum temperature has departed from said desired maximum value and whether said observable disturbance is situated within said longitudinal region, the locality nearest said discharge end being so positioned and the supply of air to said localities and the speed of kiln rotation being so selected as to achieve sufficient combustion for providing said desired maximum temperature value and as to situate said disturbance, including said maximum temperature place, in such a region such that the coke travels for 5 minutes or more from the downstream end of said disturbance to the discharge end, and adjusting at least one of the quantities of air supply, coke feed rate and kiln rotation speed as necessary from time to time, to maintain the desired maximum temperature value and location of said disturbance.

7. A method as defined in claim 6 in which said combustion of volatile material is effected to provide at least 90% of said supply of heat required for calcination of the coke.

8. A method as defined in claim 6, wherein the combustion of volatile material is effected to provide substantially all of said supply of heat for calcination of the coke, said maximum temperature being maintained at a value of at least 2000°F.

9. A method as defined in claim 6, wherein the air supply nearest the discharge end is spaced substantially from the longitudinal midpoint of the kiln, toward the discharge end.

10. A method as defined in claim 6 wherein the green coke feed has a density of not more than 1.6 g/cc and the density of the discharged product coke is determined from time to time, said maximum temperature being maintained at a value to provide a density of at least about 2 g/cc in said product coke.

11. A method as deinfed in claim 6 for calcining coke wherein said coke contains at least about 7% entrained, combustible, volatile material, and wherein the maximum temperature in the kiln is maintained at a value of at least 2000°F.

12. A method as defined in claim 11, wherein the amount of air supplied into the kiln is controlled so that substantially all of said supply of heat for calcination is provided by burning the removed volatile material in the kiln.

13. A method as defined in claim 12, wherein the maximum temperature is maintained at a value of about 2300° to 2500°F.

* * * * *

UNITED STATES PATENT AND TRADEMARK OFFICE

CERTIFICATE OF CORRECTION

PATENT NO. : 3,966,560

DATED : June 29, 1976

INVENTOR(S) : FRANK JOHN FARAGO; RAMAN RADHA SOOD; DAVID MICHAEL STOKES

It is certified that error appears in the above-identified patent and that said Letters Patent are hereby corrected as shown below:

Column 5, line 20, "ecconomy" should read -- economy --.

Column 10, line 5, "or" should read -- of --.

Column 13, line 58, Claim 6, "desired control" should read -- controlled --.

Column 14, line 55, Claim 11, "deinfed" should read -- defined --

Signed and Sealed this

Tenth Day of May 1977

[SEAL]

*Attest:*

RUTH C. MASON
*Attesting Officer*

C. MARSHALL DANN
*Commissioner of Patents and Trademarks*